United States Patent [19]

Takahashi et al.

[11] Patent Number: 4,973,355

[45] **Date of Patent: * Nov. 27, 1990**

[54] SINTERED HARD METALS AND THE METHOD FOR PRODUCING THE SAME

[75] Inventors: Kunihiro Takahashi; Toshio Nomura; Takaharu Yamamoto, all of Hyogo, Japan

[73] Assignee: Sumitomo Electric Industries, Ltd., Osaka, Japan

[ * ] Notice: The portion of the term of this patent subsequent to Sep. 22, 1998 has been disclaimed.

[21] Appl. No.: 267,644

[22] Filed: Oct. 31, 1988

Related U.S. Application Data

[63] Continuation of Ser. No. 655,314, Sep. 27, 1984, abandoned, which is a continuation of Ser. No. 5,568, Jan. 22, 1979, abandoned.

[30] Foreign Application Priority Data

| | | | |
|---|---|---|---|
| Jan. 21, 1978 | [JP] | Japan | 53-5580 |
| Jan. 27, 1978 | [JP] | Japan | 53-8840 |
| Jul. 21, 1978 | [JP] | Japan | 53-89726 |
| Aug. 10, 1978 | [JP] | Japan | 53-97487 |

[51] Int. Cl.[5] ..... C22C 29/00

[52] U.S. Cl. ..... 75/233; 75/244; 75/238; 75/246; 419/25; 419/54; 419/57; 419/12; 419/13; 419/16

[58] Field of Search ..... 428/932; 75/203, 175.5, 75/233, 244, 238, 246; 419/25, 54, 57, 12, 13, 16

[56] References Cited

U.S. PATENT DOCUMENTS

| | | | |
|---|---|---|---|
| 3,690,962 | 9/1972 | Rudy | 75/238 |
| 3,703,368 | 11/1972 | Rudy | 420/431 |
| 4,049,876 | 9/1977 | Yamamoto et al. | 428/932 |
| 4,290,807 | 9/1981 | Asai et al. | 75/233 |

OTHER PUBLICATIONS

Rudy, "Boundary Phase Stability and Critical Phenomena in Higher Order Solid Solution Systems", Journal of Less Common Metals, vol. 33, No. 1, Oct. 1973, p. 43–70.

*Primary Examiner*—Stephen J. Lechert, Jr.
*Assistant Examiner*—Nina Bhat
*Attorney, Agent, or Firm*—Wenderoth, Lind & Ponack

[57] ABSTRACT

The invention relates to sintered hard metals having high cutting properties, particularly plastic deformation resistance at high temperatures, crater resistance and the like, suitable for use as cutting tools, wear resistant tools and materials for dies, and the method for producing the same. The invention has for an object to obtain both sintered hard metals having the aforesaid high properties by sintering metallic components comprising IVa group metals, VIa group metals or metals of both groups substituted by Va group metals up to 60 mol % respectively, a B-1 type solid solution hard phase consisting of non-metallic components of C, N and O, and a metallic bonding phase, in a CO gas atmosphere, and to sintered hard metals in which an uniform hardness is imparted to the surface and interior thereof by the method of sintering the said sintered hard metal in a CO gas atmosphere.

16 Claims, 7 Drawing Sheets

I

II

SINTERED HARD METALS AND THE METHOD FOR PRODUCING THE SAME

This application is a continuation of now abandoned application Ser. No. 655,314 filed Sept. 27, 1984 which application is, in turn, a continuation of now abandoned application Ser. No. 005,568 filed Jan. 22, 1979.

BACKGROUND OF THE INVENTION

It has been a matter of common knowledge heretofore that oxygen contained in a large amount not only deteriorates sinterability but also gives rise to the growth of minute holes in the sintered hard metal thereby reducing the toughness thereof.

West German Laying-Open Gazette No. 2043411 teaches us that oxygen contained in the sintered hard metal should be strictly less than 0.15 wt %.

In "modified Spinodal Alloys for Tools and Wear Applications, 8th Plansee Seminar II (1974)" by Rudy et al, it is reported that oxygen contained up to 2.5 wt % as a sintered hard metal component does not deteriorate sinterability, but fracture toughness is reduced and no dense phases are obtainable if its content is more than 0.5 and 0.9 wt % in case of a single $\alpha'$ phase (a carbonitride phase having a small amount of Mo) and $\alpha''$ phase (a carbonitride phase having a large amount of Mo), respectively.

The method of Rudy et al is characterized in that carbonitride alloy powder (TiMo) (CN) is used as raw material.

Though the method of Rudy et al has improved the conventional method to a certain extent, there is no change in the fundamental phenomenon of the discharge of the contained oxygen, whereby the toughness of the sintered hard metal is reduced.

Thus, according to the method of Rudy et al, oxygen contained in the sintered hard metal is not stabilized and liable to be discharged as CO or $CO_2$ gas thereby reducing the toughness of the sintered hard metal. After all, it has been a conventional conception that is difficult to cause a sintered hard metal to contain oxygen therein with stability.

SUMMARY OF THE INVENTION

The invention relates to sintered hard metals extensively for use in cutting tools, wear resistant tools, dies and the like, and the method for producing the same. Said sintered hard metals comprise a B-1 type solid solution hard phase and a metallic bonding phase. The B-11 type solid solution hard phase chiefly comprises Ti and contains oxygen. The invention has for an object to obtain both sintered hard metals with highly improved cutting properties, particularly plastic deformation resistance and crater resistance at high temperatures by effecting the sintering in a CO gas atmosphere, and to sintered hard metals in which an uniform hardness is imparted to the surface and interior thereof by the method of sintering the said sintered hard metal in a CO gas atmosphere.

BRIEF DESCRIPTION OF THE DRAWINGS

FIG. 3-II shows an uniform construction of the sintered hard metal according to the invention.

FIGS. 6, 7 and 8 show the variation of the amount of the metallic bonding phase and that of oxygen from the surface to the interior of the metals according to the invention and the metals compared therewith. In the metals according to the invention, the amount of the metallic bonding phase is substantially of the same value from the surface to the interior, whereas in the metals compared therewith the amount of the metallic bonding phase is larger on the surface and smaller directly thereunder, though constant in the interior. Furthermore, the oxygen contained in the interior is more than on the surface.

DETAILED DESCRIPTION OF THE INVENTION

Figure 1:
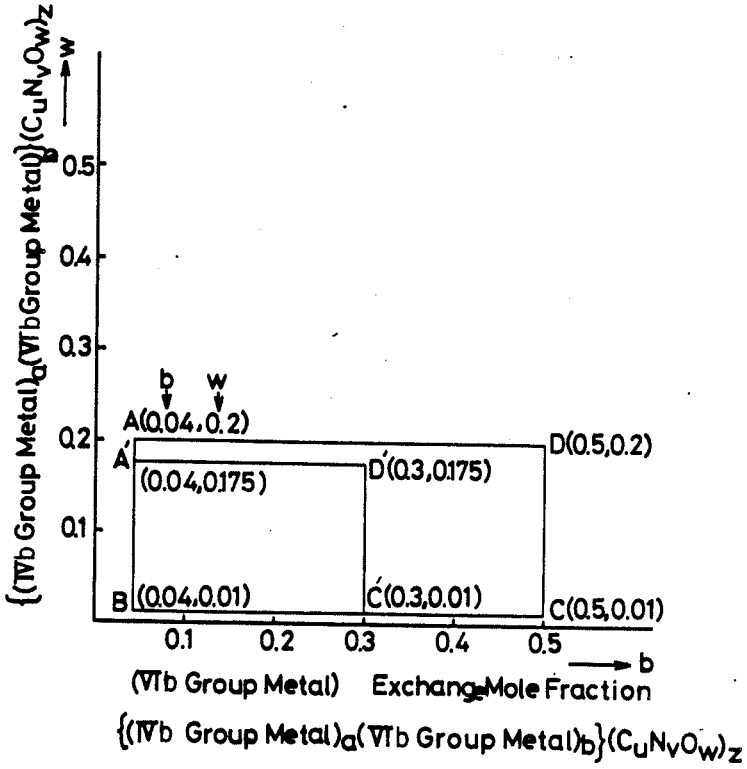
In FIG. 1, the ordinate designates mole fraction w, of oxygen, whilst the abscissa designates mole fraction b, of VIa group metals when the total composition of the B-1 type solid solution hard phase is represented by $\{(\text{IVa group metals})_a\ (\text{VIa group metals})_b\}\ (C_u, N_v, O_w)z$.

The invention relates to both sintered hard metals mainly comprising Ti and containing oxygen, and to sintered hard metals in which an uniform hardness is imparted to the surface and interior thereof by a CO gas sintering method. The method of sintering the said sintered hard metals in a CO gas atmosphere.

It has been a matter of common knowledge heretofore that too much oxygen content deteriorates the sinterability and is liable to produce minute holes in the sintered hard metal thereby reducing the toughness thereof.

It is suggested in West German Laying-Open Gazette No. 2043411 that oxygen content in sintered hard metals should be restricted to 0.15 wt % at the most.

Furthermore, in "Modified Spinodal Alloys for Tools and Wear Applications, 8th Plansee Seminar II (1974)" it is reported that oxygen content up to 25 wt % as a component of a sintered hard metal, though not harmful to sinterability, reduces the fracture toughness. It is further reported that in case of a single $\alpha'$ phase (a carbonitride phase having a small amount of Mo) and $\alpha''$ phase (a carbonitride phase having a large amount of Mo), no dense phase is obtainable when $O_2$ is more than 0.5 and 0.9 wt %, respectively.

The aforesaid method of Rudy et al is characterized in that carbonitride alloy powder (TiMo) (CN) is used as raw material. Though this may be an improvement on the conventional method to a certain extent, the fundamental phenomenon of discharge of oxygen contained in the sintered hard metal has not been altered, as a result of which toughness is necessarily reduced. According to the method of Rudy et al, oxygen is removed as much as possible since oxygen contained in sintered hard metals is liable to be discharged as CO and $CO_2$ gas thereby deteriorating the toughness of the sintered hard metals.

The inventors of the present application have discovered a method for producing sintered hard metals containing oxygen from a viewpoint completely different from the aforementioned method. The inventors have introduced a new method for producing sintered hard metals containing oxygen which is stabilized. It has been found that oxygen-containing sintered hard metals produced by this method have more improved properties compared with the sintered hard metals containing no oxygen contrary to the conventional common knowledge. The method according to the invention is characterized in that the raw materials are B-1 type solid solutions, such as powder of TiO, Ti(CO), Ti(NO), Ti(CNO) or Ti substituted by IVa group metals or Va group metals up to 50 mol % and/or the sintering is effected in a CO gas atmosphere. This method has enabled to produce sintered hard metals highly improved in respect of plastic deformation resistance at high temperatures as well as crater resistance.

Though the reason is yet to be ascertained, the comparison between the properties of TiC and those of TiO shows that the Vickers hardness of TiC and that of TiO are 3200 kg/mm$^2$ and 1700 kg/mm$^2$ respectively at normal temperature, whilst 500 kg/mm$^2$ and 660 kg/mm$^2$ respectively at 800° C. To be more precise, TiC has higher hardness at normal temperature, whereas TiO has higher hardness at high temperatures. Furthermore, TiO has much more chemically stabilized properties than TiC. Consequently, sintered hard metals in which the properties of TiO are efficiently utilized are obtainable if the sintered hard metals can be caused to contain oxygen. Furthermore, if oxygen is contained in sintered hard metals, Belag is easily formed at the time of cutting on the surface of the sintered hard metals as a result of a reaction of the oxygen contained therein thereby enabling to reduce the cutting resistance.

As described hereinbefore, powders of TiO, Ti(CO), Ti(CNO) and Ti(NO) are used as raw materials in the method according to the invention. However, Ti may be substituted by a IVa group metal or a Va group metal up to 50 mol %. In case of substitution exceeding 50 mol %, a complete solid solution is not obtainable. (The ratios of C, N and O to Ti vary as is apparent from the figure. Therefore, the representations, TiO, Ti(CO), Ti(CNO) and Ti(CO), are for the sake of expedience. The same is applicable hereinafter.)

However, Ti substituted by a VIa group metal can not be used as raw material. For example, when (TiMo)(CNO) powder is used, the more is the amount of Mo, the more unstable will be the oxygen contained in the solid solution. Thus, the oxygen is liable to be discharged in the form of CO and $CO_2$ gas, resulting in formation of minute holes in the sintered hard metal thereby reducing the toughness thereof. When IVa group metals and/or Va group metals are in the state of solid solution as in the case of the method according to the invention, gas is hardly discharged, and particularly when N and O coexist, oxygen is solidly soluble with stability.

Now, the restrictions on the metallic components and non-metallic components of the hard phase according to the invention will be described hereinunder.

The total composition of the hard phase according to the invention is represented as $\{(\text{IVa group metal})_a(\text{VIa group metal})_b\}(C_uN_vO_w)z$. The IVa group metal comprises Ti, Zr or Hf, or two or more kinds thereof in an optional ratio, whilst the VIa group metal comprises Cr, Mo or W, or two or more kinds thereof in an optional ratio. These IVa group metals and/or VIa group metals can be substituted up to 60 mol % by Va group metals selected from the group of V, Nb and Ta, respectively. Substitution exceeding 60 mol % is not preferable since it reduces wear resistance. More than 20 mol % of the metallic component of the hard phase consists of Ti, whilst Zr and Hf contribute to the improvement of wear resistance, V, Nb and Ta the improvement of toughness, Cr the improvement of corrosion reistance, and Mo and W the improvement of toughness, respectively.

The nonmetallic components of the hard phase will now be described in detail. The molar ratios of carbon, nitrogen and oxygen are represented by u, v and w, respectively. If v is less than 0.04, not only the effect of nitrogen enabling to obtain a fine-grained alloy is lost, but also the effect of stabilized oxygen content is nullified, whereas if v is more than 0.36, sinterability is deteriorated. If w is less than 0.01, the effect of oxygen content is lost, said effect being particularly great if w is more than 0.015, whilst if it is more than 0.20, sinterability is reduced. The symbol z represents a stoichiometric coefficient, showing the coupling number of gram atoms of carbon and nitrogen per gram atom of the metals (IVa group metal+VIa group metal), which varies between 0.80 and 1.05. A fragile phase exists if it is below 0.80, whilst free carbon exists if it is above 1.0. However, the properties are free from harm up to 1.05.

Figure 2:
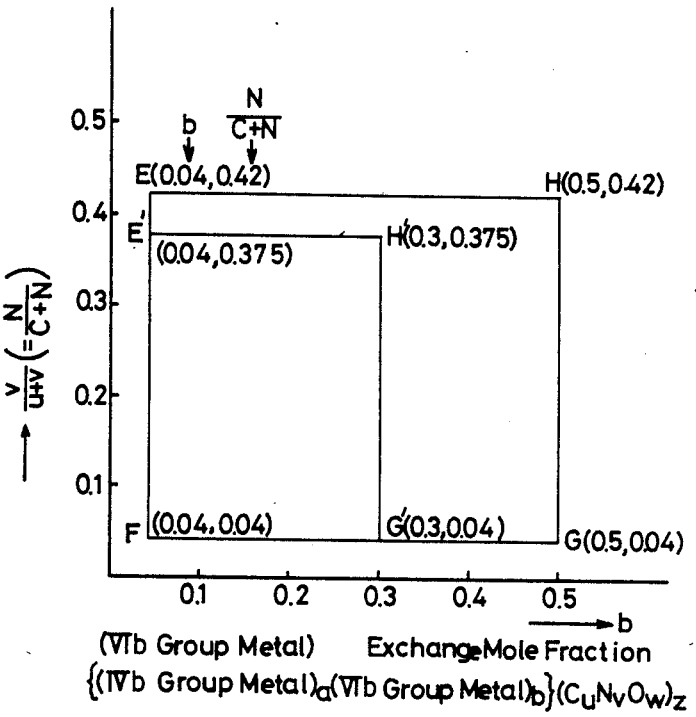
In FIG. 2, the ordinate designates N/C+N, whilst the abscissa designates mole fraction b, of the VIa group metals when the total composition of the B-1 type solid solution hard phase is represented by $\{(\text{IVa group metals})_a\ (\text{VIa group metals})_b\}$ (Cu, Nv, Ow)z.

FIGS. 1 and 2 show the area of the total composition of the hard phase according to the invention. In FIG. 1, the area defined by A, B, C and D, though more preferably a further restricted area defined by A′, B, C′ and D′, is the area of the invention. If w is more than 0.20, sinterability is deteriorated, whilst if it is less than 0.01 oxygen content is rendered useless. If b is less than 0.04, toughness is reduced, whilst ifit is more than 0.5 wear resistance is deteriorated.

In FIG. 2, the area defined by E, F, G and H, though more preferably a further restricted area defined by E′, F, G′ and H′, is the area of invention. If N/C+N is more than 0.42, sinterability is harmed, whilst if it is less than 0.04 the effect of nitrogen is lost. If b is less than 0.04, toughness is reduced, whilst if it is more than 0.50 wear resistance is deteriorated.

According to the invention, as described hereinbefore, the raw materials comprise oxides, oxycarbide, oxynitride, oxycarbonitride, whilst the materials are sintered by the method of sintering the said sintered hard metals in a CO gas atmosphere thereby enabling to preclude deoxidization and/or to enrich oxygen. By the CO gas sintering method, even powders containing no oxygen can be sintered into oxygen-containg metals. The CO gas pressure is determined within the range from 0.1 to 300 Torr for the following reasons: If below 0.1 Torr, oxygen is liable to be discharged as CO and $CO_2$ gas, whereas if above 300 Torr the amount of carbon is greatly varied due to violent cementation.

A further advantage of the sintered hard metal according to the invention will be described in detail hereinunder.

Conventionally, the TiC group sintered hard metals were known to have three disadvantages. Firstly, they were susceptible to fracture due to want of toughness; secondly, the edge was greatly deformed under high pressures at high temperatures; and thirdly their thermal fatigue resistance was smaller than that of WC group sintered hard metals.

Endeavors have heretofore been made to eliminate the aforementioned three defects. One of the most recent achievements is a method of adding nitrogen to the conventional TiC group sintered hard metals thereby enabling to obtain sintered hard metals with a finegrain hard phase having higher toughness and resistance to plastic deformation at high temperatures. The effect can be further heightened by the addition of oxygen as above described.

The aforesaid defects of the TiC group sintered hard metals have been considerably removed by this method. However, the TiC group sintered hard metals have been found to have a fourth defect. That is, in case of the TiC group sintered hard metals, the metallic phase exudes through the surface simultaneously followed directly thereunder by a harder layer than the interior thereby rendering the construction of the surface unhomogeneous from that of the interior, such phenomon never occurring in case of the WC group sintered hard metals. As a result, if cutting is effected by use of a tool without grinding the surface thereof, the tool is susceptible to fracture due to fragility of its surface.

The sintered hard metal producing method according to the invention enables to obviate the aforementioned disadvantage. To be more precise, the said fourth disadvantage can be eliminated by obtaining a sintered hard metal free from or relatively free from unhomogenity in respect of the interior construction. Since the unhomogenity is caused by surface deoxidization, the sintered hard metal having a homogeneous construction is effectively obtainable theoretically by increasing the oxygen potential in the sintering atmosphere higher than that of the interior of the sintered hard metal during the cooling process, and practically by sustaining the whole or part of the CO gas partial pressure during the cooling process higher than the CO gas partial pressure during the rise of the temperature and the solution phase sintering process.

The greatest feature of the invention consists in sustenance of the CO gas partial pressure during the whole or part of the cooling process higher than the CO partial pressure during the temperature raising process and the liquid phase-sintering process.

Conventionally, the sintered hard metal was usually sintered in a vacuum throughout the sintering process or in hydrogen under 1 atmospheric pressure through the whole or part of the sintering process. According to the conventional method, however, the bonding metal phase exudes through the surface of the sintered hard metal, there existing directly under the exuded phase a hard and fragile layer in which the ratio of the bonding metal phase to the hard layer is smaller than in the interior. As a result, the construction of the surface and that of the interior are not uniform.

Figure 3:
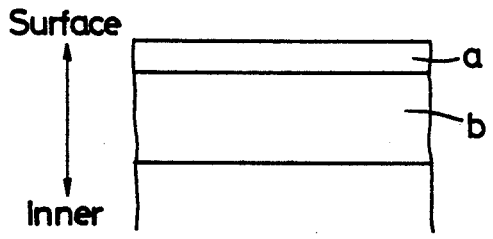
FIG. 3-I is a diagram showing the alloy construction sintered by the ordinary method. On the surface there is a phase (a) which is part of the metallic bonding phase exuded therethrough. Directly thereunder, the metallic bonding phase is reduced thereby permitting the existence of a hardened layer (b). As a result, the construction is not uniform.
Figure 3:
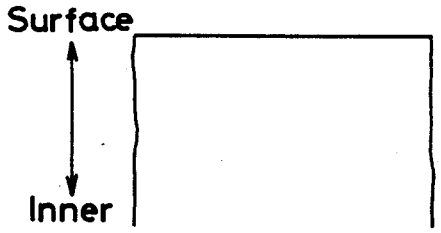

FIG. 3-I shows an un-uniform construction. Here, the effect of CO gas is very important. It has been found that, by raising the whole or part of the CO gas partial pressure during the cooling process higher than the CO gas partial pressure during the temperature raising process and the liquid phase sintering process, the exudation of the bonding metal phase through the surface can be checked thereby enabling to diffuse the metal bonding phase uniformly.

FIG. 3-II shows an uniform construction. For some reason yet to be explicated, if a CO gas atmosphere is employed during the temperature raising process and/or the liquid phase sintering process, CO gas is diffused in the pores or through the metal bonding phase whereby the oxygen concentration of the surface and that of the interior are unified, whilst if a vacuum atmosphere of $10^{-3} \sim 10^{-4}$ mmHg is employed during the cooling process, the surface is deoxidized, the oxygen concentration being reduced below that of the interior thereby permitting the metallic bonding phase to exude through the surface. If the whole or part of the CO gas partial pressure during the cooling process is raised above the CO gas partial pressure during the temperature raising process and the liquid phase sintering process, the oxygen concentration of the surface becomes higher than that of interior thereby preventing the metallic bonding phase from exuding through the surface and simultaneously helping it to diffuse uniformly.

The hardness of the sintered hard metal 0.005~0.2 mm in depth from the surface is determined as less than 1.02 times that 1.0 mm in depth from the surface for the reason that, in case of more than 1.02 times, the edge is susceptible to fracture if used without grinding. According to the conventional sintering method, the hardness 0.005~0.2 mm in depth from the surface is 1.04~1.06 times that 1.0 mm in depth from the surface.

This phenomenon is not restricted to metals containing Ti but common particularly to the B-1 type solid solution of IVa, Va, VIa group metals with the nonmetallic components comprising carbon, nitrogen and oxygen.

Since the invention is characterized in that the intended effect is obtained by sustaining the oxygen potential during the cooling process higher than that of the interior of the sintered hard metal, it is needless to mention that inert gas (He, Ar, Hz, etc.) may be used in combination with CO gas. In this case, the CO gas should be sustained at a predetermined partial pressure. Moreover, $H_2O$, $CO_2$ gas coexist to some extent.

Furthermore, the cutting properties can be improved by adding Zr and/or Al to this sintered hard metal containing oxygen. Among the conventional sintered hard metals there have been known a type in which wear resistance and heat resistant tenacity have been improved by adding Zr to the sintered hard metal, and another type in which the bonding phase has been reinforced by adding Al. However, if Zr and/or Al is added to the sintered hard metal containing oxygen, not only the bonding phase is reinforced but also endowed with properties similar to zirconium oxide and aluminum oxide whereby the wear resistance and thermal resistant tenacity are improved. Assuming that the whole of the sintered hard metal accounts for 100 weight %, the suitable amount of Zr is 0.01~10 wt %, whilst that of Al is 0.1~10 wt. %.

The aforesaid effect is lost if Zr and Al are less than 0.01 and 0.1 wt % respectively, whilst sinterability is deteriorated if they are more than 10 wt %, respectively. A better effect is obtainable if one or more than two of Cu, Ag, Si, B in addition to ferrous metals are added up to 0.2~25 wt % of the bonding metals. To be more precise, the addition of Cu helps to control the granular growth, to improve the thermal conductivity, and moreover to homoginize the construction of the surface and that of the interior. The addition of Ag serves to enhance the moistening property thereby enabling to obtain better thermal conductivity. The addition of Si and B also contributes to the improvement of sinterability.

It goes without saying that the metallic bonding phase contains hard phase forming elements, such as Ti, Zr, Al, Hf, V, Nb, Ta, Cr, Mo, W, C, N, O and the like. Thus the sintered hard metals obtainable by the method according to the invention are characterized by their high features, such as cutting properties, plastic deformation resistance at high temperatures, crater resistance and the like. Therefore, they are extensively for use not only in cutting tools but also in ball-point pens, dies, wear resistant members, ornaments and the like.

The invention will now be described in more detail with reference to the following examples.

EXAMPLE 1

Commercial TiC powder, TiN powder, WC powder, $Mo_2C$ powder, $Ti(C_{0.5}O_{0.5})$ powder made of TiO powder and TiC powder, $Ti(N_{0.5}O_{0.5})$ powder made of TiO powder and TiN powder, Ni powder, Co powder, TaN powder and TaC powder were mixed in the ratios as shown in Table 1 to obtain hard phase compositions as shown in Table 2, respectively. The powders were mixed for 96 hours by adding acetone thereto in a wet ball mill comprising balls 10 mm in diameter made of TiC-Ni-Mo and a 18-8 stainless steel lined pot.

The mixtures were pressed under 2 t/cm$^2$ after adding 3% of camphor thereto. The pressed bodies were sintered in a vacuum of $10^{-3}$ mm Hg until the temperature was raised to 1200° C., then under a CO gas partial pressure sustained at 50 Torr up to 1380° C., subsequently in a vacuum at 1380° C. for 60 minutes to obtain sintered hard metals, respectively. The mechanical properties of the hard metals thus obtained are shown in Table 3, whilst the cutting properties thereof are shown in Table 4.

TABLE 1

| | | (%) | | | | | | | | | |
|---|---|---|---|---|---|---|---|---|---|---|---|
| | | i | ii | iii | iv | v | vi | vii | viii | ix | x |
| Metals of Invention (CO sintered) | A | 35 | 13 | 4 | — | 12 | — | 9 | 12 | 5 | 10 |
| | B | 28 | 12 | — | 4 | 15 | — | 12 | 14 | 15 | — |
| | C | 15 | 9 | 3 | 3 | — | — | 35 | 20 | 7 | 8 |
| Metals Compared (Vacuum sintered) | D | 44 | 5 | — | — | 12 | — | 15 | 9 | 10 | 5 |
| | E | 28 | 10 | — | — | 15 | 12 | 6 | 14 | 7 | 8 |
| | F | 6 | 4 | — | — | — | 20 | 35 | 20 | 7 | 8 |

Notes:
i → TiC, ii → TiN, iii → $Ti(C_{0.5}O_{0.5})$, iv → $Ti(N_{0.5}O_{0.5})$, v → TaN, vi → TaC, vii → $Mo_2C$, viii → WC, ix → Ni, x → Co

TABLE 2

| | | (Hard Phase Composition) |
|---|---|---|
| Metal of Invention | A | $(Ti_{0.80}Ta_{0.057}W_{0.057}Mo_{0.083})(C_{0.67}N_{0.29}O_{0.04})_{0.8692}$ |
| | B | $(Ti_{0.73}Ta_{0.08}W_{0.072}Mo_{0.12})(C_{0.64}N_{0.33}O_{0.034})_{0.9455}$ |
| | C | $(Ti_{0.52}W_{0.11}Mo_{0.37})(C_{0.72}N_{0.22}O_{0.06})_{0.8164}$ |
| Metal Compared | D | $(Ti_{0.76}Ta_{0.06}W_{0.043}Mo_{0.14})(C_{0.86}N_{0.14})_{0.9309}$ |
| | E | $(Ti_{0.70}Ta_{0.16}W_{0.08}Mo_{0.065})(C_{0.72}N_{0.23})_{0.9704}$ |
| | F | $(Ti_{0.23}Ta_{0.15}W_{0.14}Mo_{0.48})(C_{0.88}N_{0.12})_{0.7606}$ |

TABLE 3

| | Metal of Invention | | | Metal Compared | | |
|---|---|---|---|---|---|---|
| | A | B | C | D | E | F |
| Fracture Resistance (kg/mm$^2$) | 157 | 167 | 151 | 148 | 153 | 191 |
| Hardness (VHN) | 1560 | 1510 | 1540 | 1500 | 1545 | 1490 |

TABLE 4

| | | Wear Resistance Test | | Plastic Deformation Resistance | Thermal Fatigue Resistant Tenacity |
|---|---|---|---|---|---|
| | | Flank Wear (mm) | Crater Wear (mm) | Edge Regression Amount (mm) | (Fracture Cycle) |
| Metal of Invention | A | 0.08 | 0.03 | 0.05 | 1200 |
| | B | 0.09 | 0.04 | 0.04 | 1000 |
| | C | 0.10 | 0.06 | 0.09 | 1300 |
| Metal Compared | D | 0.15 | 0.13 | 0.18 | 1100 |
| | E | 0.20 | 0.11 | 0.20 | 1050 |
| | F | 0.35 | 0.20 | 0.35 | 1800 |

Test Condition
Wear Resistance Test: SCM3 Ⓗ, V = 200m/min, d = 1.5 mm, f = 0.35 mm/rev, G = 15 min
Plastic Deformation Resistance Test: SK5, V = 200 m/min, d = 1.5 mm, f = 0.36 mm/rev, T = 10 min
Thermal Fatigue Resistant Tenacity Test: SCM3 Ⓗ (with V-slot), V = 150 m/min, d = 1.5 mm, f = 0.59 mm/rev, T = until fractured

EXAMPLE 2

Commercial TiC powder, TiN powder, WC powder, $Mo_2C$ powder, Ni powder and Co powder were mixed in the ratios as shown in Table 5 to obtain the hard phase compisitions as shown in Table 6, respectively. The powders were mixed for 96 hours by adding acetone thereto in a wet ball mill comprising TiC-Ni-Mo-made balls 10 mm in diameter and a 18-8 stainless steel lined pot. The mixtures, after adding 3% of camphor thereto, were pressed under 25/cm$^2$. The pressed bodies were sintered in a vacuum of $10^{-3}$ mm Hg up to 1200° C., then under a CO gas partial pressure maintained at 200 Torr from 1200° C. to 1380° C., and subsequently in a vacuum at 1380° C. for 60 minutes and then under a CO gas partial pressure raised to 250 Torr at the time of cooling. Table 7 shows the CO gas sintered hard phase compositions. Table 8 shows the mechanical properties of the metals thus obtained, whilst Table 9 shows the cutting properties thereof.

TABLE 5

| | | (%) | | | | | | | |
|---|---|---|---|---|---|---|---|---|---|
| | | TiC | TiN | TaN | TaC | $Mo_2C$ | WC | Ni | Co |
| Metal of Invention (CO Sintered) | G | 38 | 18 | 5 | — | 9 | 15 | 5 | 10 |
| | H | 44 | 5 | 8 | 4 | 15 | 9 | — | 15 |
| | I | 44 | 15 | — | — | 10 | 15 | 7 | 8 |
| | J | 38 | 18 | 5 | — | 9 | 15 | 5 | 10 |
| Metal Compared (Vacuum | K | 44 | 5 | 8 | 4 | 15 | 9 | 10 | 5 |
| | L | 44 | 15 | — | — | 10 | 15 | 7 | 8 |

TABLE 5-continued

| | TiC | TiN | TaN | TaC | $Mo_2C$ | WC | Ni | Co |
|---|---|---|---|---|---|---|---|---|
| | (%) | | | | | | | |
| sintered) | | | | | | | | |

TABLE 6

| | | (Hard Phase Composition Ratio) |
|---|---|---|
| Metal of Invention | G | $(Ti_{0.83}Ta_{0.023}W_{0.07}Mo_{0.08})(C_{0.70}N_{0.30})_{0.9646}$ |
| | H | $(Ti_{0.76}Ta_{0.06}W_{0.04}Mo_{0.14})(C_{0.88}N_{0.12})_{0.9323}$ |
| | I | $(Ti_{0.86}W_{0.07}Mo_{0.085})(C_{0.78}N_{0.22})_{0.9608}$ |
| Metal Compared | J | $(Ti_{0.83}Ta_{0.023}W_{0.07}Mo_{0.08})(C_{0.70}N_{0.30})_{0.9646}$ |
| | K | $(Ti_{0.76}Ta_{0.06}W_{0.04}Mo_{0.14})(C_{0.88}N_{0.12})_{0.9323}$ |
| | L | $(Ti_{0.85}W_{0.07}Mo_{0.085})(C_{0.78}N_{0.22})_{0.9608}$ |

TABLE 7

| | | (CO Gas Sintered Hard Phase Composition) |
|---|---|---|
| Metal of Invention | G | $(Ti_{0.83}Ta_{0.023}W_{0.07}Mo_{0.07})(C_{0.67}N_{0.28})_{0.982}$ |
| | H | $(Ti_{0.76}Ta_{0.06}W_{0.04}Mo_{0.14})(C_{0.84}N_{0.12}O_{0.04})_{0.960}$ |
| | I | $(Ti_{0.85}W_{0.07}Mo_{0.085})(C_{0.75}N_{0.21}O_{0.04})_{0.9680}$ |

EXAMPLE 3

Commerical TiC powder, TiN powder, WC powder, $Mo_2C$ powder, TiO powder, Ti(CNO) powder made of TiO powder, TiC powder and TiN powder, Ni powder, Co powder, Al powder, Cu powder, Ag powder, TaN powder, and TaC powder were mixed in the ratios as shown in Table 10 to obtain the hard phase compositions as shown in Table 11. The powders were mixed for 96 hours by adding acetone thereto in a wet ball mill comprising TiC-Ni-Mo-made balls 10 mm in diameter and a 18-8 stainless steel lined pot. The mixtures with 3% of camphor added thereto were pressed under 2 $t/cm^2$.

The pressed bodies were sintered under a CO gas partial pressure sustained at 5 Torr from 800° C. to 1380° C., then in a vacuum at 1380° C. for 60 minutes, and subsequently under a CO gas partial pressure sustained at 50 Torr until the temperature was lowered to 800° C. The mechanical properties of the sintered hard metals thus obtained are shown in Table 12, whilst the cutting properties thereof are shown in Table 13.

TABLE 10

| | | i | ii | iii | iv | v | vi | vii | viii | ix | x | xi | xii | xiii |
|---|---|---|---|---|---|---|---|---|---|---|---|---|---|---|
| | | (%) | | | | | | | | | | | | |
| Metal of Invention (CO sintered) | M | 33 | 10 | 4 | — | 12 | — | 11 | 15 | 5 | 10 | — | — | — |
| | N | 19 | 8 | — | 30 | 10 | — | 8 | 10 | 7 | 8 | — | — | — |
| | O | 40 | 8 | — | 4 | 10 | — | 7 | 16 | 4 | 10 | 1 | — | — |
| | P | 21 | 14 | — | 10 | 8 | 7 | 15 | 10 | 6 | 8 | — | 1 | — |
| | Q | 44 | 13 | — | 5 | 13 | — | 6 | 4 | 4 | 10 | — | — | 1 |
| | R | 28 | 8 | 2 | 6 | 10 | 9 | 20 | 2 | 5 | 10 | — | — | — |
| Metal Compared (Vacuum sintered) | S | 37 | 10 | — | — | 12 | — | 11 | 15 | 5 | 10 | — | — | — |
| | T | 38 | 17 | — | — | 12 | — | 8 | 10 | 7 | 8 | — | — | — |
| | U | 9 | 8 | — | 50 | — | 10 | 7 | 16 | 5 | 10 | — | — | — |
| | V | 31 | 14 | — | — | 8 | 7 | 15 | 10 | 6 | 8 | — | — | — |
| | W | 16 | 46 | 3 | — | 13 | — | 4 | 3 | 4 | 11 | — | — | — |
| | X | 33 | 11 | — | — | 10 | 9 | 20 | 2 | 5 | 10 | — | — | — |

Notes:
i → TiC, ii → TiN, iii → TiO, iv → $Ti(C_{0.3}N_{0.3}O_{0.4})$, v → TaN, vi → TaC, vii → $Mo_2C$, viii → WC, ix → Ni, x → Co, xi → Al, xii → Cu, xiii → Ag

TABLE 8

| | Metal of Invention | | | Metal Compared | | |
|---|---|---|---|---|---|---|
| | G | H | I | J | K | L |
| Fracture Resistance ($kg/mm^2$) | 159 | 161 | 149 | 154 | 151 | 145 |
| Hardness (MHV) | 1571 | 1580 | 1591 | 1583 | 1610 | 1620 |

TABLE 11

| | | (Hard Phase Composition) |
|---|---|---|
| Metal of Invention | M | $(Ti_{0.76}Ta_{0.06}W_{0.02}Mo_{0.11})(C_{0.704}N_{0.231}O_{0.065})_{0.9045}$ |
| | N | $(Ti_{0.84}Ta_{0.05}W_{0.05}Mo_{0.07})(C_{0.52}N_{0.30}O_{0.18})_{0.9646}$ |
| | O | $(Ti_{0.81}Ta_{0.05}W_{0.08}Mo_{0.065})(C_{0.708}N_{0.194}O_{0.025})_{0.9648}$ |
| | P | $(Ti_{0.73}Ta_{0.08}W_{0.05}Mo_{0.15})(C_{0.593}N_{0.34}O_{0.068})_{0.9312}$ |
| | Q | $(Ti_{0.88}Ta_{0.06}W_{0.02}Mo_{0.05})(C_{0.707}N_{0.264}O_{0.028})_{0.9745}$ |
| | R | $(Ti_{0.55}Ta_{0.15}W_{0.015}Mo_{0.30})(C_{0.70}N_{0.225}O_{0.075})_{1.033}$ |
| Metal Compared | S | $(Ti_{0.76}Ta_{0.06}W_{0.08}Mo_{0.11})(C_{0.77}N_{0.23})_{0.948}$ |
| | T | $(Ti_{0.83}Ta_{0.06}W_{0.05}Mo_{0.07})(C_{0.69}N_{0.31})_{0.9646}$ |
| | U | $(Ti_{0.84}Ta_{0.04}W_{0.06}Mo_{0.05})(C_{0.45}N_{0.29}O_{0.26})_{0.9761}$ |
| | V | $(Ti_{0.73}Ta_{0.08}W_{0.05}Mo_{0.14})(C_{0.72}N_{0.28})_{0.9286}$ |

TABLE 9

| | | Wear Resistance Test | | Plastic Deformation Resistance | Thermal Fatigue Resistant Tenacity |
|---|---|---|---|---|---|
| | | Flank Wear (mm) | Crater Wear (mm) | Edge Regression Amount (mm) | (Fracture Cycle) |
| Metal of Invention | G | 0.09 | 0.04 | 0.04 | 1100 |
| | H | 0.10 | 0.07 | 0.07 | 1200 |
| | I | 0.08 | 0.08 | 0.03 | 700 |
| Metal Compared | J | 0.21 | 0.17 | 0.19 | 1000 |
| | K | 0.25 | 0.20 | 0.22 | 1100 |
| | L | 0.20 | 0.15 | 0.20 | 800 |

Test Condition
Wear Resistance Test: SCM3 Ⓗ, V = 200 m/min, d = 1.5 mm, f = 0.36 mm/rev, T = 15 min
Plastic Deformation Resistance Test: Sk5, V = 200 m/min, d = 1.5 mm, f = 0.36 mm/rev, T = 10 min
Thermal Fatigue Resistant Tenacity Test: SCM3 Ⓗ, V = 150 m/min, d = 1.5 mm, f = 0.59 mm/rev, T = until fractured TABLE 11-continued

| | (Hard Phase Composition) |
|---|---|
| W | $(Ti_{0.90}Ta_{0.06}W_{0.01}Mo_{0.03})(C_{0.26}N_{0.70}O_{0.04})_{0.983}$ |
| X | $(Ti_{0.71}Ta_{0.10}W_{0.01}Mo_{0.20})(C_{0.78}N_{0.22})_{0.9075}$ |

TABLE 12

| | Metal of Invention | | | | | | Metal Compared | | | | | |
|---|---|---|---|---|---|---|---|---|---|---|---|---|
| | M | N | O | P | Q | R | S | T | U | V | W | X |
| Fracture Resistance ($kg/mm^2$) | 161 | 149 | 167 | 156 | 169 | 165 | 151 | 162 | 100 | 159 | 111 | 170 |
| Hardness (MHV) | 1590 | 1500 | 1550 | 1600 | 1594 | 1600 | 1599 | 1580 | 1450 | 1620 | 1420 | 1587 |

TABLE 13

| | | Wear Resistance Test | | Plastic Deformation | Thermal Fatigue Resistant |
|---|---|---|---|---|---|
| | | Flank Wear (mm) | Crater Wear (mm) | Resistance Edge Regression Amount (mm) | Tenacity (Fracture Cycle) |
| Metal of | M | 0.10 | 0.02 | 0.02 | 1000 |
| | N | 0.12 | 0.09 | 0.04 | 1300 |
| Invention | O | 0.07 | 0.04 | 0.03 | 1200 |
| | P | 0.11 | 0.06 | 0.02 | 1100 |
| | Q | 0.08 | 0.04 | 0.05 | 1000 |
| | R | 0.07 | 0.03 | 0.06 | 990 |
| Metal Compared | S | 0.17 | 0.15 | 0.20 | 1000 |
| | T | 0.21 | 0.11 | 0.18 | 1500 |
| | U | 0.41 | 0.35 | 0.40 | 300 |
| | V | 0.15 | 0.14 | 0.15 | 900 |
| | W | 0.45 | 0.40 | 0.45 | 200 |
| | X | 0.22 | 0.20 | 0.19 | 1300 |

Test Condition

Wear Resistance Test:

SCM3 H, V = 200 m/min, d = 1.5 mm, f = 0.36 mm/rev, T = 15 min

Plastic Deformation Resistance Test:

SK5, V = 200 m/min, d = 1.5 mm, f = 0.36 mm/rev, T = 10 min

Thermal Fatigue Resistant Tenacity Test:

SCM3 H (with V-slot), V = 150 m/min, d = 1.5 mm, f = 0.59 mm/rev, T = until fractured

EXAMPLE 4

Commercial TiC powder, TiN powder, WC powder, $Mo_2C$ powder, ZrC powder, HfC powder, NbC powder, $Cr_3C_2$ powder, Ti (CON) powder made of TiO poefrt, TiN Powder and TaN powder, (TiTa)(NO) powder made of TiO powder, TiN powder and TaN powder, Ni powder, Co powder, TaN powder, and TaC powder were mixed in the ratios as shown in Table 14 to obtain the hard phase compositions as shown in Table 15. The powders were mixed for 96 hours by adding acetone thereto in a wet ball mill comprising TiC-Ni-Mo-made balls 10 mm in diameter and a 18–8 stainless steel lined pot. The mixtures with 3% of comphor added thereto were pressed under 2 $t/cm^2$. The pressed bodies were sintered in a vacuum at 1380° C. for 60 minutes. The mechanical properties of the sintered hard metals thus obtained are shown in Table 16, whilst the cutting properties thereof are shown in Table 17.

TABLE 14

| | | (%) | | | | | | | | | | | | | |
|---|---|---|---|---|---|---|---|---|---|---|---|---|---|---|---|
| | | TiC | TiN | $Ti(C_{0.3}N_{0.3}O_{0.4})$ | $(Ti_{0.7}Ta_{0.3})(N_{0.5}O_{0.5})$ | TaN | TaC | ZrC | HfC | NbC | $Cr_3C_2$ | $Mo_2C$ | WC | Ni | Co |
| Metal of Invention (Vacuum Sintered) | A-1 | 20 | 11 | 20 | 5 | 11 | — | — | — | — | — | 8 | 10 | 5 | 10 |
| | B-1 | 28 | 10 | 15 | — | — | — | — | — | — | — | 12 | 20 | 7 | 8 |
| | C-1 | 14 | 11 | 10 | 3 | 15 | — | 10 | — | — | — | 7 | 15 | 6 | 9 |
| | D-1 | 25 | 9 | 13 | 4 | — | 5 | — | 11 | — | — | 6 | 12 | 4 | 11 |
| | E-1 | 5 | 5 | 12 | 10 | 10 | 5 | — | | 9 | — | 20 | 9 | 7 | 8 |
| | F-1 | 15 | 11 | 19 | 8 | 6 | — | — | — | | 12 | 4 | 10 | 5 | 10 |
| | G-1 | 30 | 14 | 20 | — | — | — | — | — | — | — | — | 21 | 10 | 5 |
| Metal Compared (Vacuum sintered) | H-1 | 43 | 5 | 1 | — | 14 | — | — | — | — | — | 10 | 12 | 5 | 10 |
| | I-1 | 2 | 1 | 49 | — | — | — | — | — | — | — | 10 | 23 | 7 | 8 |
| | J-1 | 20 | 15 | — | — | 20 | — | 9 | — | — | — | 6 | 15 | 4 | 11 |
| | K-1 | 22 | 11 | — | — | — | 10 | — | 12 | — | — | 20 | 10 | 6 | 9 |
| | L-1 | 30 | 13 | — | — | 9 | 8 | — | — | 10 | — | 5 | 10 | 5 | 10 |
| | M-1 | 15 | 10 | — | — | 18 | — | — | — | — | 12 | 18 | 12 | 10 | 5 |
| | N-1 | 55 | — | 5 | — | — | — | — | — | — | — | — | 25 | 10 | 5 |

TABLE 15

| | | (Hard Phase Composition) |
|---|---|---|
| Metal of Invention | A-1 | $(Ti_{0.81}Ta_{0.07}W_{0.05}Mo_{0.07})(C_{0.51}N_{0.34}O_{0.15})_{0.965}$ |
| | B-1 | $(Ti_{0.80}W_{0.09}Mo_{0.11})(C_{0.68}N_{0.22}O_{0.10})_{0.9487}$ |
| | C-1 | $(Ti_{0.64}Zr_{0.11}Ta_{0.09}W_{0.08}Mo_{0.08})(C_{0.55}N_{0.36}O_{0.09})_{0.963}$ |
| | D-1 | $(Ti_{0.79}Hf_{0.06}Ta_{0.04}W_{0.06}Mo_{0.06})(C_{0.67}N_{0.23}O_{0.10})_{0.970}$ |
| | E-1 | $(Ti_{0.51}Ta_{0.09}Nb_{0.10}W_{0.06}Mo_{0.24})(C_{0.52}N_{0.32}O_{0.16})_{0.919}$ |
| | F-1 | $(Ti_{0.70}Ta_{0.05}Cr_{0.18}W_{0.05}Mo_{0.03})(C_{0.52}N_{0.32}O_{0.15})_{0.925}$ |
| | G-1 | $(Ti_{0.91}W_{0.09})(C_{0.61}N_{0.28}O_{0.11})_{1.004}$ |
| Metal Compared | H-1 | $(Ti_{0.78}Ta_{0.07}W_{0.06}Mo_{0.09})(C_{0.835}N_{0.158}O_{0.006})_{0.9512}$ |
| | I-1 | $(Ti_{0.80}W_{0.11}Mo_{0.09})(C_{0.43}N_{0.25}O_{0.31})_{0.9551}$ |
| | J-1 | $(Ti_{0.64}Zr_{0.10}Ta_{0.11}W_{0.09}Mo_{0.06})(C_{0.60}N_{0.40})_{0.9634}$ |
| | K-1 | $(Ti_{0.60}Hf_{0.07}Ta_{0.06}W_{0.06}Mo_{0.22})(C_{0.78}N_{0.22})_{0.8931}$ |
| | L-1 | $(Ti_{0.72}Ta_{0.09}Nb_{0.10}W_{0.05}M_{0.05})(C_{0.74}N_{0.26})_{0.9729}$ |
| | M-1 | $(Ti_{0.44}Ta_{0.10}Cr_{0.21}W_{0.07}Mo_{0.19})(C_{0.64}N_{0.36})_{0.8395}$ |
| | N-1 | $(Ti_{0.89}W_{0.11})(C_{0.95}N_{0.02}O_{0.03})_{1.001}$ |

TABLE 16

| | Metal of Invention | | | | | | | Metal Compared | | | | | | |
|---|---|---|---|---|---|---|---|---|---|---|---|---|---|---|
| | A-1 | B-1 | C-1 | D-1 | E-1 | F-1 | G-1 | H-1 | I-1 | J-1 | K-1 | L-1 | M-1 | N-1 |
| Fracture | 160 | 165 | 161 | 160 | 168 | 162 | 160 | 165 | 110 | 159 | 165 | 161 | 169 | 155 |

TABLE 16-continued

| | Metal of Invention | | | | | | | Metal Compared | | | | | | |
|---|---|---|---|---|---|---|---|---|---|---|---|---|---|---|
| | A-1 | B-1 | C-1 | D-1 | E-1 | F-1 | G-1 | H-1 | I-1 | J-1 | K-1 | L-1 | M-1 | N-1 |
| Resistance ($kg/mm^2$) | | | | | | | | | | | | | | |
| Hardness (VHN) | 1590 | 1550 | 1595 | 1550 | 1500 | 1585 | 1597 | 1550 | 1310 | 1598 | 1610 | 1605 | 1599 | 1600 |

TABLE 17

| | | Wear Resistance Test | | Plastic Deformation Resistance | Thermal Fatigue Resistant |
|---|---|---|---|---|---|
| | | Flank | Crater | Edge | Tenacity |
| Metal of Invention | A-1 | 0.11 | 0.10 | 0.09 | 1000 |
| | B-1 | 0.07 | 0.04 | 0.03 | 1200 |
| | C-1 | 0.12 | 0.09 | 0.09 | 900 |
| | D-1 | 0.08 | 0.03 | 0.04 | 1100 |
| | E-1 | 0.09 | 0.07 | 0.06 | 1150 |
| | F-1 | 0.11 | 0.12 | 0.09 | 990 |
| | G-1 | 0.05 | 0.05 | 0.07 | 1200 |
| Metal Compared | H-1 | 0.21 | 0.17 | 0.20 | 1000 |
| | I-1 | 0.19 | 0.17 | 0.19 | 500 |
| | J-1 | 0.25 | 0.22 | 0.22 | 1100 |
| | K-1 | 0.30 | 0.20 | 0.20 | 1000 |
| | L-1 | 0.22 | 0.19 | 0.19 | 990 |
| | M-1 | 0.25 | 0.21 | 0.30 | 1000 |
| | N-1 | 0.21 | 0.17 | 0.20 | 1000 |

Test Condition

Wear Resistance Test:

SCM3 H, V = 200 m/min, d = ,.5 mm, f = 0.36 mm/rev, T = 15 min

Plastic Deformation Resistance Test:

SK5, V = 200 m/min, d = 1.5 mm, f = 0.36 mm/rev, T = 10 min

Thermal Fatigue Resistant Tenacity Test:

SCM3 H, V = 150 m/min, d = 1.5 mm, f = 0.59 mm/rev, T = until fractured

EXAMPLE 5

Table 18 given hereinunder shows the overall compositions of the hard phases of a multiplicity of tools made of compositions comprising a plurality of metal substitution products. The mechanical properties and the cutting properties of the sintered hard metals made therefrom by the same method as in Example 4 are shown in Table 19 and Table 20, respectively.

TABLE 18

| | | Overall Composition of Hard Phase | Bonding Agent (wt %) |
|---|---|---|---|
| Metal of Invention | A-2 | $(Ti_{0.8}Ta_{0.125}W_{0.05}Mo_{0.025})(C_{0.765}N_{0.135}O_{0.10})_{0.987}$ | 15 Co |
| | B-2 | $(Ti_{0.8}Zr_{0.05}W_{0.15})(C_{0.595}N_{0.255}O_{0.16})_{0.99}$ | 15 Ni |
| | C-2 | $(Ti_{0.725}W_{0.20}Mo_{0.075})(C_{0.625}N_{0.267}O_{0.11})_{0.954}$ | 5 Ni, 10 Co |
| | D-2 | $(Ti_{0.75}Hf_{0.10}W_{0.12})(C_{0.831}N_{0.119}O_{0.5})_{0.990}$ | 1 Fe, 1 Al, 4 Ni, 9 Co |
| | E-2 | $(Ti_{0.8}Nb_{0.075}W_{0.125})(C_{0.8775}N_{0.975}O_{0.025})_{0.987}$ | 1 Cu, 3 Ni, 11 Co |
| | F-2 | $(Ti_{0.82}V_{0.03}Mo_{0.15})(C_{0.50}N_{0.31}O_{0.19})_{0.899}$ | 1 Ag, 14 Co |
| | G-2 | $(Ti_{0.72}Gr_{0.03}W_{0.15}Mo_{0.10})(C_{0.49}N_{0.32}O_{0.19})_{0.998}$ | 0.5 Si, 25 Ni, 12 Co |
| | H-2 | $(Ti_{0.60}W_{0.31}Mo_{0.09})(C_{0.595}N_{0.255}O_{0.15})_{0.901}$ | 0.5 B, 4.5 Ni, 10 Co |
| | I-2 | $(Ti_{0.55}W_{0.35}Mo_{0.10})(C_{0.784}N_{0.166}O_{0.05})_{0.996}$ | 7 Ni, 8 Co |
| Metal Compared | J-2 | $(Ti_{0.825}W_{0.10}Mo_{0.075})(C_{0.98}N_{0.015}O_{0.005})_{0.976}$ | 7 Ni, 8 Co |
| | K-2 | $(Ti_{0.9}Ta_{0.073}W_{0.01}Mo_{0.015})(C_{0.72}N_{0.18}O_{0.10})_{0.990}$ | 15 Ni |
| | L-2 | $(Ti_{0.77}Nb_{0.08}W_{0.10}Mo_{0.05})(C_{0.41}N_{0.34}O_{0.25})_{1.02}$ | 15 Co |
| | M-2 | $(Ti_{0.525}Ta_{0.05}Nb_{0.025}W_{0.40})(C_{0.362}N_{0.363}O_{0.275})_{0.901}$ | 1 Fe, 4 Ni, 10 Co |
| | N-2 | $(Ti_{0.45}Cr_{0.02}W_{0.37}Mo_{0.16})(C_{0.474}N_{0.316}O_{0.21})_{0.965}$ | 1 Mo, 2 Ni, 12 Co |
| | O-2 | $(Ti_{0.42}Hf_{0.03}W_{0.45}Mo_{0.10})(C_{0.68}N_{0.17}O_{0.15})_{0.97}$ | 5 Ni, 10 Co |
| | P-2 | $(Ti_{0.425}W_{0.575})(C_{0.807}N_{0.143}O_{0.05})_{0.89}$ | 1 Al, 8 Ni, 6 Co |

TABLE 19

| | Metal of Invention | | | | | | | | | Metal Compared | | | | | | |
|---|---|---|---|---|---|---|---|---|---|---|---|---|---|---|---|---|
| | A-2 | B-2 | C-2 | D-2 | E-2 | F-2 | G-2 | H-2 | I-2 | J-2 | K-2 | L-2 | M-2 | N-2 | O-2 | P-2 |
| Fracture Resistance ($kg/mm^2$) | 145 | 165 | 175 | 159 | 150 | 165 | 161 | 170 | 190 | 159 | 125 | 101 | 105 | 205 | 210 | 200 |
| Hardness (MHV) | 1625 | 1590 | 1550 | 1570 | 1565 | 1580 | 1510 | 1490 | 1450 | 1600 | 1670 | 1100 | 1300 | 1450 | 1410 | 1400 |

TABLE 20

| | | Wear Resistance Test | | Plastic | Thermal Fatigue Resistant |
|---|---|---|---|---|---|
| | | Flank Wear (mm) | Crater Wear (mm) | Deformation Resistance Test | Tenacity (Fracture Cycle) |
| Metal of Invention | A-2 | 0.09 | 0.02 | 0.01 | 1100 |
| | B-2 | 0.08 | 0.03 | 0.01 | 1200 |
| | C-2 | 0.06 | 0.03 | 0.02 | 1400 |
| | D-2 | 0.11 | 0.04 | 0.02 | 1400 |
| | E-2 | 0.10 | 0.02 | 0.03 | 980 |
| | F-2 | 0.15 | 0.09 | 0.05 | 1000 |
| | G-2 | 0.14 | 0.08 | 0.06 | 1100 |
| | H-2 | 0.13 | 0.09 | 0.09 | 1500 |
| | I-2 | 0.11 | 0.09 | 0.08 | 1600 |
| Metal Compared | J-2 | 0.13 | 0.10 | 0.15 | 800 |
| | K-2 | 0.08 | 0.05 | 0.09 | 550 |
| | L-2 | 0.40 | 0.35 | 0.14 | 300 |
| | M-2 | 0.55 | 0.40 | 0.20 | 200 |
| | N-2 | 0.60 | 0.45 | 0.29 | 500 |
| | O-2 | 0.50 | 0.20 | 0.35 | 900 |
| | P-2 | 0.35 | 0.21 | 0.41 | 1000 |

Test Condition

Wear Resistance Test:

SCM3 H V = 200 m/min, d = 1.5 mm, f = 0.36 mm/rev, T-15 min

Plastic Deformation Resistance Test:

SK5, V = 200 m/min, d = 1.5 mm, f = 0.36 mm/rev, T = 10 min

TABLE 20-continued

| Thermal Fatigue Resistant Tenacity Test: |
|---|
| SCM3 H, V = 150 m/min, d = 1.5 mm, f = 0.59 mm/rev, T = until fractured |

EXAMPLE 6

Commercial TiC {expediently designated as TiC though primarily $TiC_{1-x}$ (wherein x is 0 or less than 1) -nd the same is applicable hereinafter)} powder having a mean particle size of 1 μ (total carbon amount 19.70%, free carbon amount 0.35%), TiN powder having substantially the same particle size (nitrogen amount 20.25%), WC powder (total carbon amount 6.23%, free carbon amount 0.11%), $Mo_2C$ powder (total carbon amount 5.89%, free carbon amount 0.03%), Co powder below 100 meshes and Ni powder below 287 meshes were mixed in the ratios as shown in Table 21. The powders were mixed for 96 hours by adding acetone thereto in a wet ball mill comprising TiC-Ni-Mo-made balls 10 mm in diameter and a 18-8 stainless steel lined pot. The mixtures with 3% of camphor added thereto were pressed under 2 t/cm². The pressed bodies were sintered under a CO gas partial pressure sustained at 5 Torr and a gas flux at 0.5 1/min during the rise of the temperature from 1200° C. to 1380° C., then in a vaccum of $10^{-3} \sim 10^{-4}$ mm/Hg at 1380° C. for 60 minutes, and subsequently under a CO gas partial pressure 15 Torr and a gas flux 0.5 1/min until the temperature was lowered to 800° C.

Figure 4:
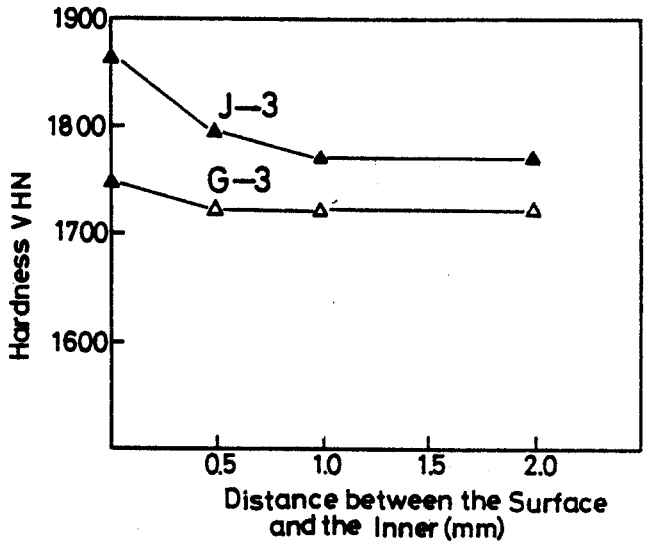
FIGS. 4 and 5 show the variation of hardness from the surface to the interior of the sintered hard metal according to the invention and the metal compared therewith, respectively. G-3 and M-3 designate the metals according to the invention, whilst J-3 and P-3 designate the metals compared therewith. As is apparent from these figures, the hardness of the metals according to the invention has substantially same value both on the surface and in the interior.
Figure 6:
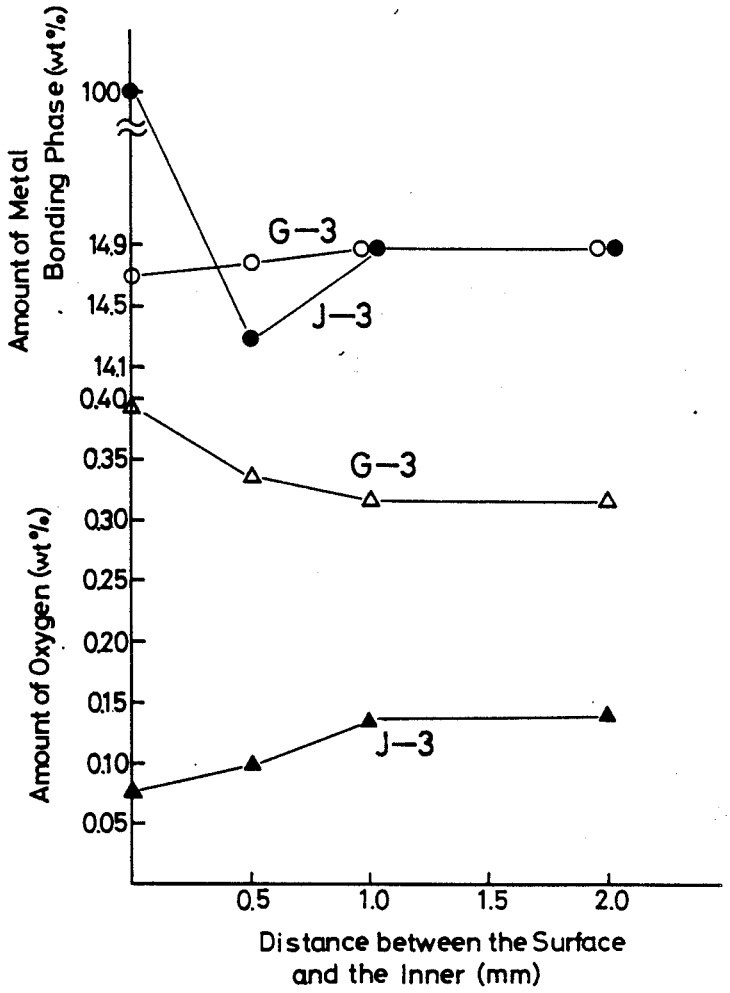

The mechanical properties of the sintered hard metals thus obtained are shown in Table 22. The distribution of hardness from the surface to the interior is shown in FIG. 4, whilst the amount of the metal bonding phase and that of oxygen from the surface to the interior are shown in FIG. 6. Table 23 shows the result of the cutting test by use of tools without surface grinding.

TABLE 21

| | (%) Metal of Invention CO gas partial pressure 5 Torr from 1200° C. to 1380° C. subsequently in vacuum $10^{-4}$ mmHg 15 Torr for 60 minutes at 1380° C. | | | Metal Compared Vacuum Sintered $10^{-4}$ mmHg | | |
|---|---|---|---|---|---|---|
| | G-3 | H-3 | I-3 | J-3 | K-3 | L-3 |
| TiC | 25 | 45 | 50 | 24 | 46 | 52 |
| TiN | 35 | 15 | 10 | 36 | 14 | 8 |
| $Mo_2C$ | 10 | 10 | 20 | 9 | 12 | 19 |
| WC | 15 | 15 | 5 | 16 | 13 | 6 |
| Ni | 7 | 7 | 10 | 7 | 7 | 10 |
| Co | 8 | 8 | 5 | 8 | 8 | 5 |

TABLE 22

| | Metal of Invention | | | Metal Compared | | |
|---|---|---|---|---|---|---|
| | G-3 | H-3 | I-3 | J-3 | K-3 | L-3 |
| Fracture Resistance (kg/mm²) | 140 | 161 | 158 | 142 | 159 | 160 |
| Hardness (VHN) | 1700 | 1650 | 1690 | 1710 | 1700 | 1670 |
| Amount of Oxygen (Wt %) | 0.32 | 0.30 | 0.32 | 0.14 | 0.14 | 0.13 |

TABLE 23

| | | Result of Wear | Resistance Test | |
|---|---|---|---|---|
| | | Result of Intermittent Test | Flank Wear (mm) | Crater Wear (mm) |
| Metal of Invention | G-3 | 2 min 30 sec unfractured | 0.08 | 0.02 |
| | H-3 | 2 min 40 sec | 0.09 | 0.01 |
| | I-3 | 2 min 10 sec unfractured | 0.07 | 0.02 |
| Metal Compared | J-3 | 9 sec fractured | 0.13 | 0.02 |
| | K-3 | 4 sec fractured | 0.15 | 0.04 |
| | L-3 | 40 sec fractured | 0.11 | 0.01 |

Test Condition

Intermittent Test:

Work SCM3(H)Hs 38 ± 2
Diameter 100 mm
V = 100 m/min d = 2 mm
f = 0.2 mm/rev, T = 2 min Wear Resistance Test:

Work SCM 3(H) Hs 38 ± 2
Diameter 200 mm
V = 200 m/min, d = 1.5 mm
f = 0.36 m/rev, T = 10 min The result of the test in Table 23 shows that the sintered hard metals according to theinvention have far greater resistance not only to fracture but also to wear.

EXAMPLE 7

Figure 5:
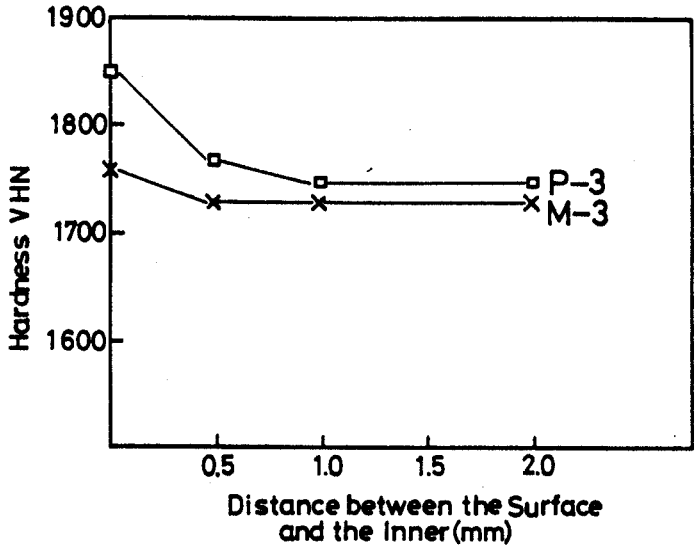
Figure 7:
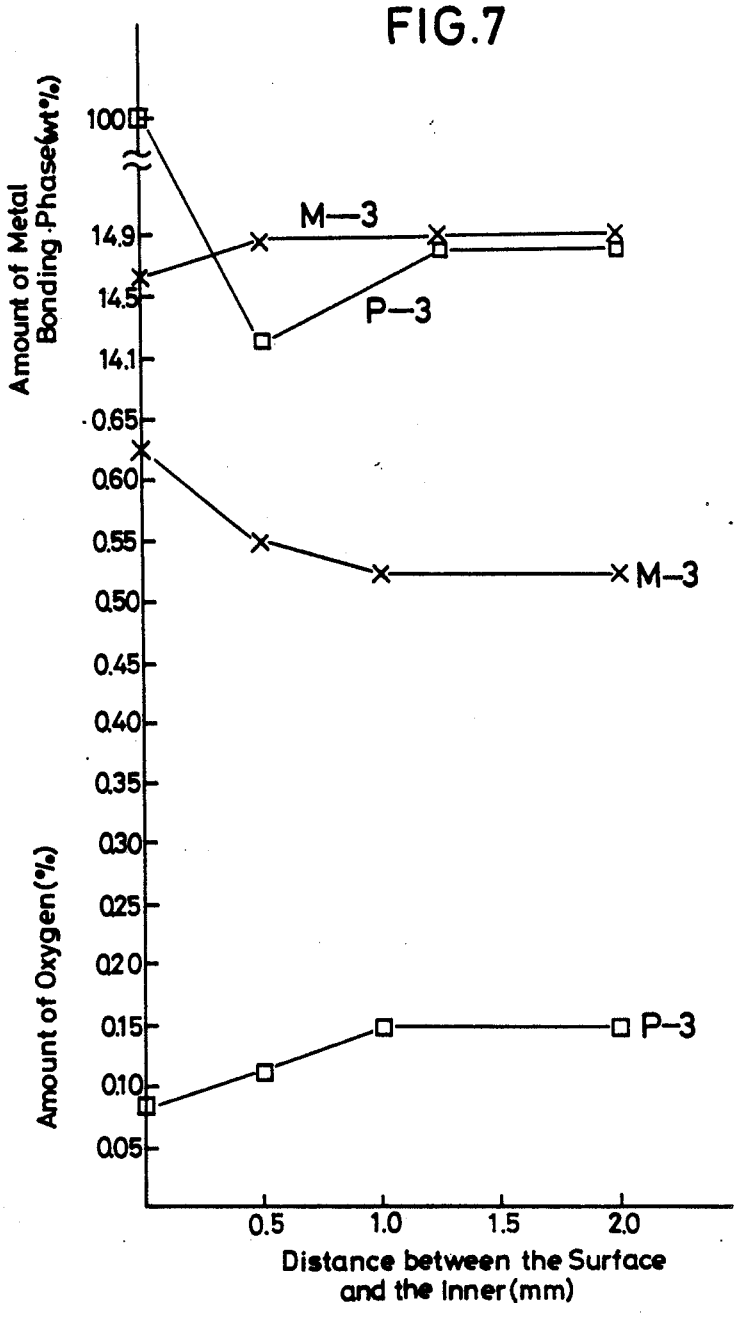

Commercial TiC {expediently designated as TiC though primarily $TiC_{1-x}$ (wherein x is 0 or less than 1) and the same is applicable hereinafter} powder having a mean particle size of 1 μ (total carbon amount 19.70%, free carbon amount 0.35%), TiN powder having substantially the same particle size (nitrogen amount 20.25%), $Ti(C_{0.5}O_{0.5})$ powder, WC powder (total carbon amount 6.23%, free carbon amount 0.11%), $Mo_2C$ powder (total carbon amount 5.89%, free carbon amount 0.08%), Co powder below 100 meshes and Ni powder below 287 meshes were mixed in the ratios as shown in Table 24. The powders were mixed for 96 hours by adding acetone thereto in a wet ball mill comprising TiC-Ni-Mo-made balls 10 mm in diameter and a 18-8 stainless steel lined pot. The mixtures with 3% of camphor added thereto were pressed under 2 t/cm². The pressed bodies were sintered at 1380° C. in a vacuum of $10^{-3} \sim 10^{-4}$ mmHg for 60 minutes, and subsequently under a CO gas partial pressure sustained at 5 Torr and a gas flux at 0.5 1/min until the temperature was lowered to 800° C. The mechanical properties of the sintered hard metals thus obtained are shown in Table 25. The hardness distribution from the surface to the interior is shown in FIG. 5, whilst the metal bonding phase amount and the oxygen amount from the surface to the interior are shown in FIG. 7. The result of a cutting test by use of tools without surface grinding is shown in Table 26.

TABLE 24

| | (%) Metal of Invention CO gas atmosphere 5 Torr at cooling time | | | Metal Compared Vacuum Sintered $10^{-4}$ mmHg | | |
|---|---|---|---|---|---|---|
| | M-3 | N-3 | O-3 | P-3 | Q-3 | R-3 |
| TiC | 22 | 43 | 48 | 25 | 45 | 50 |
| TiN | 35 | 15 | 10 | 35 | 15 | 10 |
| $Ti(C_{0.5}O_{0.5})$ | 3 | 2 | 2 | — | — | — |
| $Mo_2C$ | 10 | 10 | 20 | 12 | 14 | 18 |
| WC | 15 | 15 | 5 | 13 | 11 | 7 |
| Ni | 7 | 7 | 10 | 7 | 7 | 10 |

TABLE 24-continued

| | (%) Metal of Invention CO gas atmosphere 5 Torr at cooling time | | | Metal Compared Vacuum Sintered $10^{-4}$ mmHg | | |
|---|---|---|---|---|---|---|
| | M-3 | N-3 | O-3 | P-3 | Q-3 | R-3 |
| Co | 8 | 8 | 5 | 8 | 8 | 5 |

TABLE 25

| | Metal of Invention | | | Metal Compared | | |
|---|---|---|---|---|---|---|
| | M-3 | N-3 | O-3 | P-3 | Q-3 | R-3 |
| Fracture Resistance ($kg/mm^2$) | 147 | 159 | 158 | 141 | 160 | 151 |
| Hardness (VHN) | 1680 | 1700 | 1690 | 1692 | 1721 | 1691 |
| Amount of Oxygen | 0.52 | 0.55 | 0.54 | 0.14 | 0.13 | 0.13 |

(wt %)

TABLE 26

| | | Result of Intermittent Test | Result Wear Resistance Test Flank Wear (mm) | Crater Wear (mm) |
|---|---|---|---|---|
| Metal of Invention | M-3 | 2 min unfractured | 0.07 | 0.02 |
| | N-3 | 1 min 30 sec fractured | 0.09 | 0.02 |
| | O-3 | 2 min unfractured | 0.08 | 0.03 |
| Metal Compared | P-3 | 10 sec fractured | 0.14 | 0.01 |
| | Q-3 | 5 sec fractured | 0.13 | 0.02 |
| | R-3 | 30 sec fractured | 0.11 | 0.03 |

Test Condition

| | |
|---|---|
| Intermittent Test | Work SCM 3 H Hs 38 2<br>Diameter 100 mm<br>V = 100 m/min, d = 2 mm<br>f = 0.2 mm/rev, T = 2 min |
| Wear Resistance Test | Work SCM 3 H HS 38 2<br>Diameter 200 mm<br>V = 200 m/min, d = 1.5 mm<br>f = 0.36 mm/rev, T = 10 min |

The result of the cutting test in Table 26 shows that the sintered hard metals according to the invention have far greater resistance not only to fracture but also to wear.

EXAMPLE 8

Commercial TiC powder (expediently designated as TiC though primarily TiCx, and the same is applicable hereinafter), TiN powder, WC powder, $Mo_2C$ powder, $Ti(C_{0.5}O_{0.5})_{0.98}$ powder, $Ti_2AlC$ powder, Ni powder, TaN powder and Co powder were mixed in the ratios as shown in Table 27. The powders were mixed for 96 hours by adding acetone thereto in a wet ball mill comprising TiC-Ni-Mo-made balls 10 mm in diameter and 18–8 stainless steel lined pot. The mixtures with 3 weight % of camphor added thereto were pressed under 2 $t/cm^2$. The pressed bodies thus obtained were sintered in a vacuum below $10^{-3}$ mmHg until the temperature was raised to 1200° C., then under a CO gas partial pressure sustained at 20 Torr from 1200° C. to 1380° C., and then in a vacuum below $10^{-3}$ mmHg at 1380° C. for 60 minutes, and subsequently under a CO gas partial pressure sustained at 50 Torr until the temperature was lowered to 800° C. The result of analysis of the sintered hard metals thus obtained is shown in Table 28. The mechanical properties of the sintered hard metals are shown in Table 29, whilst the cutting properties thereof are shown in Table 30.

TABLE 27

| | (Composition of Mixture) (wt %) | | | | | | | | |
|---|---|---|---|---|---|---|---|---|---|
| | TiC | TiN | $Ti(C_{0.5}O_{0.5})_{0.98}$ | $Ti_2AlC$ | TaN | $Mo_2C$ | WC | Ni | Co |
| S-3 | 30 | 15 | 3 | 2 | 5 | 10 | 20 | 5 | 10 |
| T-3 | 37 | 12 | — | — | 6 | 11 | 19 | 6 | 9 |

Notes
S-3: Metal according to the invention (CO sintered)
T-3: Metal compared (vacuum sintered)

TABLE 28

| | Composition of Sintered Hard Metals Molar Ratio | Wt % Al Analytical Value | Ni Analytical Value | Co Analytical Value |
|---|---|---|---|---|
| S-3 | $(Ti_{0.78}Ta_{0.02}W_{0.10}Mo_{0.10})(C_{0.70}N_{0.27}O_{0.08})_{0.94}$ | 0.3 | 4.9 | 9.8 |
| T-3 | $(Ti_{0.77}Ta_{0.03}W_{0.10}Mo_{0.10})(C_{0.77}N_{0.23})_{0.95}$ | — | 5.8 | 8.9 |

TABLE 29

| | S-3 | T-3 |
|---|---|---|
| Fracture Resistance ($kg/mm^2$) | 175 | 169 |
| Hardness (MHV) | 1625 | 1620 |

TABLE 30

| | Flank Wear (mm) | Crater Wear (mm) | Thermal Fatigue Resistant Tenacity Test (Fracture Cycle) |
|---|---|---|---|
| S-3 | 0.07 | 0.02 | Fractured at 1500 cycles |
| T-3 | 0.15 | 0.05 | Fractured at 900 cycles |

Test Condition

| | |
|---|---|
| Wear Resistance Test | SCM 3, V = 200 m/min, d = 1.5 mm, f = 0.36 mm/rev, T = 10 min |
| Thermal Fatigue Resistant Tenacity Test | SCM 3 (with slot), V = 150 m/min, d = 1.5 mm, f = 0.59 mm/rev, T = until fractured |

EXAMPLE 9

Commercial TicC powder, TiN powder, WC powder, $Mo_2C$ powder, $TiO_{0.95}$powder, Ni powder, Co powder, TaN powder, ZrN powder and AlN powder were mixed in the ratios as shown in Table 31. The powders were mixed for 96 hours by additing acetone thereto in a wet ball mill comprising TiC-Mo-Ni-made balls 10 mm in diameter and a 18–8 stainless steel lined pot. The mixtures with 3% of camphor added thereto were pressed under 2 t/cm$^2$.

The pressed bodies were sintered in a vacuum of $10^{-3}$ mmHg until the temperature was raised to 1200° C., then until a CO gas partial pressure sustained at 50 Torr from 1200° to 1380° C., and subsequently in a vacuum below $10^{-3}$ mmHg at 1380° C. for 60 minutes. The result of analysis of the sintered hard metals thus obtained as shown in Table 33. The mechanical properties of the sintered hard metals are shown in Table 32, whilst the cutting properties thereof are shown in Table 34.

As is apparent from Table 32 and Table 34, the metals according to the invention, that is, U-3 containing Zr and oxygen and V-3 containing Zr, Al and oxygen, have far higher properties than those of the metal compared, that is, W-3, in respect of wear resistance, plastic deformation resistance and thermal fatigue resistant tenecity, though there is little difference between the two types in respect of fracture resistance and hardness. It is to be noted that V-3 containing Zr, Al and oxygen has particularly high properties.

TABLE 31

| | (Composition Ratio by wt %) | | | | | | | | | |
|---|---|---|---|---|---|---|---|---|---|---|
| | TiC | TiN | $TiO_{0.95}$ | ZrN | TaN | $Mo_2C$ | WC | AlN | Ni | Co |
| U-3 | 33 | 15 | 2 | 1 | 4 | 10 | 20 | — | 5 | 10 |
| V-3 | 32 | 14 | 2 | 1 | 4 | 10 | 20 | 2 | 5 | 10 |
| W-3 | 35 | 16 | — | — | 4 | 10 | 20 | — | 5 | 10 |

Notes
U-3, V-3: Sintered hard metals according to the invention (CO sintered)
W-3: Metal compared (Vacuum sintered)

TABLE 32

| | U-3 | V-3 | W-3 |
|---|---|---|---|
| Fracture Resistance (kg/mm$^2$) | 165 | 164 | 165 |
| Hardness (MHV) | 1650 | 1624 | 1630 |

TABLE 33

| | (Composition of Sintered Hard Metal) | | | | |
|---|---|---|---|---|---|
| | Hard Composition (Analytical Molar Ratio) | Al Analytical Value | Zr Analytical Value | Ni Analytical Value | Co Analytical Value |
| U-3 | $(Ti_{0.78}Zr_{0.01}Ta_{0.02}W_{0.10}Mo_{0.09})(C_{0.7}N_{0.27}O_{0.03})_{0.95}$ | — | 0.85 | 4.9 | 9.9 |
| V-3 | $(Ti_{0.78}Zr_{0.01}Ta_{0.02}W_{0.20}Mo_{0.09})(C_{0.7}N_{0.27}O_{0.03})_{0.95}$ | 1.3 | 0.85 | 4.9 | 9.9 |
| W-3 | $(Ti_{0.79}Ta_{0.02}W_{0.10}Mo_{0.09})(C_{0.73}N_{0.27})_{0.94}$ | — | — | 4.9 | 9.9 |

Note
Analytical Value: wt %

TABLE 34

| | Wear Resistance Test | | Plastic Deformation Resistance Test | Thermal Fatigue |
|---|---|---|---|---|
| | Flank Wear (mm) | Crater Wear (mm) | Edge Regression Amount (mm) | Resistant Tenacity Test (Fracture Cycle) |
| U-3 | 0.05 | 0.04 | 0.04 | Fractured at 1200 cycles |
| V-3 | 0.05 | 0.05 | 0.03 | Fractured at 1500 cycles |
| W-3 | 0.10 | 0.10 | 0.10 | Fractured at 800 cycles |

Test Condition

| | |
|---|---|
| Wear Resistance Test | SCM3, V = 200 m/min, d = 1.5 mm, f = 0.36 mm/rev, T = 10 min |
| Plastic Deformation Resistance Test | SK5, V = 170 m/min, d = 1.5 mm, f = 0.16 mm/rev, T = 1 min |
| Thermal Fatigue | SCM3 (with slot), V = 150 m/min, d = 1.5 mm, f = 0.59 mm/rev, T = until fractured |

wherein V: Cutting Speed d: Cutting Amount f: Feed T: Time

What is claimed is:

1. A sintered hard metal comprising a B-1 type solid solution hard phase and a metallic bonding phase, characterized in that the metallic components constituting the hard phase comprise IVb group metals and VIb group metals or such metals substituted by Vb group metals up to 60 mol %, the nonmetallic components of the hard phase comprising C, N and O, the whole composition of the hard phase being within the area defined by A, B, C and D. in FIG. 1 and E, F, G and H in FIG. 2, wherein when the whole composition of the hard phase is represented in atomic ratio as {(IVb group metals)$_a$(VIb group metals)$_b$} $(C_uN_vO_w)_z$, interrelations of $a+b=1$, $a \geqq b$, and $u+v+w=1$ exist between a, b, u, v and w, the respective ranges of u, v, w and z being $$0.49 \leqq u \leqq 0.95$$

$$0.04 \leqq v \leqq 0.36$$

$$0.01 \leqq w \leqq 0.20$$

$$0.80 \leqq z \leqq 1.05$$

said metallic bonding phase comprising ferrous metals, the amount of bonding metals comprising 3–25 wt % based on 100 wt % of the sintered hard metal.

2. A sintered hard metal as defined in claim 1, wherein w designating the mole fraction of oxygen is in the relation of $0.0.15 \leqq w \leqq 0.20$.

3. A sintered hard metal as defined in claim 1 or 2, wherein more than 20 mol % of the metallic components of the hard phase is accounted for by Ti.

4. A sintered hard metal as defined in claim 1 or claim 3, wherein the whole composition of the hard phase is within the area defined by A', B, C' and D' in FIG. 1 and E', F, G' and H' in FIG. 2.

5. A sintered hard metal as defined in claim 1, 2, 3 or 4 wherein one or more than two kinds of titanium monooxide powder, titanium oxycarbide powder and titanium oxynitride powder and titanium oxycarbonitride powder are mixed with carbides, nitrides and carbonitride thereby enabling the sintered hard metal to contain oxygen.

6. A sintered hard metal as defined in claim 5, wherein Ti is substituted by one or more than two kinds of IVa group metals and Va group metals up to 50 mol %.

7. A sintered hard metal as defined in any one claims 1–6, wherein hard compounds comprising IVa, Va, VIa group metals and nonmetallic components are bonded chiefly by ferrous metals, the metallic component of the hard phase mainly comprising Ti, the nonmetallic components of the hard phase containing oxygen, the hardness of the sintered hard metal 0.005–0.02 mm in depth from the surface thereof being more than 1.02 times the hardness 1.0 mm in depth from said surface.

8. A sintered hard metal as defined in any one claims 1–6, wherein hard compounds comprising IVa, Va, VIa group metals and nonmetallic compounds are bonded mainly by ferrous metals, the metal components of the hard phase chiefly comprising Ti, the nonmetallic components of the hard phase containing carbon, nitrogen and oxygen, the surface of the sintered hard metal being free from exudation of the metallic bonding phase.

9. A sintered hard metal as defined in any one of claims 1–6, wherein hard compounds comprising IVa, Va, VIa group metals and nonmetallic components are bonded by ferrous metals, the metallic components of the hard phase chiefly comprising Ti, the nonmetallic components of the hard phase containing carbon, nitrogen and oxygen, the oxygen content up to 0.005~0.2 mm in depth from the surface of the sintered hard metal being higher than that 1.0 mm in depth from the surface.

10. A sintered hard metal as defined in claim 9, wherein hard compounds comprising IVa, Va, VIa group metals and nonmetallic components are bonded by ferrous metals, the metallic components of the hard phase chiefly comprising Ti, the nonmetallic components of the hard phase containing carbon, nitrogen and oxygen, the hardness of the sintered hard metal up to 0.005~0.02 mm in depth from the surface being less than 1.02 times the hardness 1.0 mm in depth from the surface, the surface of the sintered hard metal being free from exudation of the metallic bonding phase therethrough.

11. A sintered hard metal as defined in any one of claims 1–6, wherein said sintered hard metal contains Zr and/or Al in its components, Zr accounting for 0.01~10 wt % and Al for 0.1~10 wt % assuming that the whole sintered hard metal is 100 wt %.

12. A sintered hard metal as defined in claim 11, wherein Zr is metallic Zr or a Zr compound, Al being a hard compound comprising Al, more than one of IVa, Va, VIa group metals and more than one of C, N and O.

13. A sintered hard metal as defined in any one of claims 1–6, wherein more than one of Cu, Ag, Si and B are added up to 0.2–25 wt % of the bonding metals in addition to the ferrous metals.

14. A method for producing a sintered hard metal comprising a B-1 type solid solution hard phase and a metallic bonding phase characterized in that a CO gas partial pressure is sustained at 0.01~300 Torr during the whole or part of the temperature raising, sintering and cooling processes thereby enabling the sintered hard metal to contain oxygen by precluding deoxidation and/or enriching oxygen, the metallic components constituting the hard phase having IVb group metals and VIb groups metals or such metals substituted by Vb group metals up to 60 mol %, the nonmetallic components of the hard phase comprising C, N and O, the whole composition of the hard phase being within the area defined by A, B, C and D in FIG. 1 and E, F, G and H in FIG. 2, wherein when the whole composition of the hard phase is represented in atomic ratio as $\{(\text{IVb group metals})_a(\text{VIb group metals})_b\}(C_uN_vO_w)_z$, interrelations of $a+b=1$, $a \geqq b$, and $u+v+w=1$ exist between a, b, u, v and w, the respective ranges of u, v, w and z being $$0.49 \leqq u \leqq 0.95$$

$$0.04 \leqq v \leqq 0.36$$

$$0.01 \leqq w \leqq 0.20$$

$$0.80 \leqq z \leqq 1.05$$

said metallic bonding phase comprising ferrous metals, the amount of bonding metals comprising 3–25 wt % based on 100 wt % of the sintered hard metal.

15. A method for producing a sintered hard metal as defined in claim 14, further characterized in that the CO gas partial pressure during the whole or part of the cooling process is sustained higher than the CO gas partial pressure during the temperature raising process and solution phase sintering process.

16. A method for producing a sintered hard metal as defined in claim 14, further characterized in that oxygen potential in the atmosphere during the whole or part of the sintereing process and cooling process is sustained higher than oxygen potential inside the sintered hard metal.

* * * * *